US006106636A

United States Patent [19]

Naito et al.

[11] Patent Number: 6,106,636

[45] Date of Patent: Aug. 22, 2000

[54] METHOD AND APPARATUS FOR CONTROLLING THE ATMOSPHERE IN A HEAT TREATMENT FURNACE

[75] Inventors: Takeshi Naito; Kouichi Ogihara; Akihiro Wakatsuki; Tadanori Nakahiro; Hideki Inoue; Yoshio Nakashima, all of Tokyo, Japan

[73] Assignee: Dowa Mining Co., Ltd., Tokyo, Japan

[21] Appl. No.: 09/024,543

[22] Filed: Feb. 17, 1998

[30] Foreign Application Priority Data

Feb. 18, 1997 [JP] Japan ..... 9-048598

[51] Int. Cl.[7] ..... C23C 8/22; C21D 1/06

[52] U.S. Cl. ..... 148/215; 148/216; 148/235; 266/251; 266/252

[58] Field of Search ..... 148/215, 216, 148/235; 266/251, 252

[56] References Cited

U.S. PATENT DOCUMENTS 4,372,790 2/1983 Gohring et al. .

4,950,334 8/1990 Nishioka et al. .

FOREIGN PATENT DOCUMENTS

| | | | |
|---|---|---|---|
| 0 738 785 | 10/1996 | European Pat. Off. . | |
| 2152440 | 10/1972 | Germany | 148/216 |
| 47-28300 | 7/1972 | Japan | 148/216 |
| 53-54931 | 9/1978 | Japan . | |
| 59-159567 | 12/1984 | Japan . | |
| 62-243754 | 10/1987 | Japan . | |
| 63260 | 7/1990 | Japan . | |
| 3-193863 | 8/1991 | Japan . | |
| 4-063260 | 2/1992 | Japan . | |
| 2092183 | 8/1982 | United Kingdom | 148/216 |

*Primary Examiner*—Deborah Yee
*Attorney, Agent, or Firm*—Nilles & Nilles SC

[57] ABSTRACT

In a method of and apparatus for controlling an atmosphere in a heat treatment furnace according to the present invention, a carburizing is carried out while supplying a hydrocarbon series gas and an oxidization gas into the furnace. The quantity of a residual $CH_4$, a partial pressure of the oxidization gas and a partial pressure of CO are measured. The quantity of each gas to be supplied into the furnace is controlled according to either one of the values of the partial pressures.

15 Claims, 8 Drawing Sheets

(×400) ENDOTHERMIC METHOD METHOD OF PRESENT INVENTION

FIG. 11

| CARBURIZATION AT 930°C : DEPTH OF EFFECTIVE HARDENED LAYER | |
|---|---|
| ENDOTHERMIC GAS METHOD | METHOD OF PRESENT INVENTION |
| $CO_2$ GAS : 0 ℓ | $CO_2$ GAS : 742 ℓ |
| $C_4H_{10}$ GAS : 9700 ℓ | $C_4H_{10}$ GAS : 3006 ℓ |

COMPARISON OF COMSUMED GAS QUANTITIES IN PRESENT INVENTION AND ENDOTHERMIC GAS METHOD

METHOD AND APPARATUS FOR CONTROLLING THE ATMOSPHERE IN A HEAT TREATMENT FURNACE

BACKGROUND OF THE INVENTION

1. Field of the Invention

This invention relates to a method and apparatus for controlling an atmosphere in a heat treatment furnace, and more particularly relates to a method of and apparatus for controlling an atmosphere in a heat treatment furnace for carrying out a gas carburizing, carbonitriding or bright controlled atmosphere heat treatment, etc.

2. Description of the Prior Art

In conventional heat treatment methods, such as gas carburizing of metals, a mixture of a hydrocarbon gas and air is converted into an endothermic gas through the use of an endothermic type converted gas generator. The endothermic gas is introduced into the furnace, and an enriched hydrocarbon gas is added to the furnace in order to obtain a predetermined carbon potential.

However, recently, in order to enhance the quality, and to reduce the treatment time and running cost, the gas generators are no longer desirable. Rather, introducting a hydrocarbon gas and an oxidizing gas are directly into the furnace to carry out the carburizing in the furnace has been proposed.

Such method is described in Japanese Patent Applications Laid-Open Nos.159567/1986 and 63260/1992.

However, in the method shown in the Japanese Patent Application Laid-Open No.159567/1986, the oxidization gas to be added in the furnace is oxygen, the partial pressure of CO is approximately 29% when $CH_4$ is used as the hydrocarbon gas, and the partial pressure of CO is approximately 38% when $C_4H_{10}$ is used as the hydrocarbon gas. In the method shown in the Japanese Patent Application Laid-Open No.63260/1992, the partial pressure of CO is approximately 40% in case that $CO_2$ is used and butane is used as the hydrocarbon gas. According to the conventional methods, the carburizing time can be shortened, because the partial pressure of CO is higher than that in the other normal method. However, the oxidization at the grain boundary layer of the goods to be treated is promoted.

Furthermore, the partial pressure of CO in the atmosphere in the furnace fluctuates because a large quantity of air is introduced into the furnace when the goods to be treated are inserted into and taken out of the furnace. In the method shown in the Japanese Patent Application Laid-Open No. 63260/1992, the quantity of the hydrocarbon gas to be supplied into the furnace is controlled so that the carbon potential in the atmosphere becomes constant. However, in fact, the atmosphere is varied to a large extent according to the change of the type (weight and surface area) of goods to be treated, and accordingly the fluctuation of the carbon potential becomes large, so that the fluctuation in the surface carbon contents of steel becomes large.

Furthermore, the carburizing speed in the direct carburizing method is varied on a large scale according to the carburizing time and the diffusion time. In the carburizing time, the main effect is the direct decomposition of the hydrocarbon gas, etc. (raw gas) and in the diffusion time, the main effect is the Boundouard reaction.

In the carburizing time, the degree of the decomposition varies due to the quantity of the hydrocarbon gas to be introduced directly into the furnace and the temperature of the atmosphere in the furnace as well as the type of goods to be treated in the furnace. As a result, hydrocarbon gas in excess of the amount required for carburizing is piled as a soot in the furnace, thereby potentially subjecting the goods to be treated to soot.

If the heat treatment is carried out in the sooting range, the service life of the oxygen sensor becomes reduced.

SUMMARY OF THE INVENTION

Accordingly, an object of the present invention is to obviate the above defects.

A further object of the present invention is to provide a method of controlling an atmosphere in a heat treatment furnace comprising the steps of carburizing while supplying a hydrocarbon gas and an oxidization gas into the furnace, and stopping the supply of the oxidization gas when the partial pressure of CO in the furnace reaches a predetermined value.

Another object of the present invention is to provide a method of controlling an atmosphere in a heat treatment furnace comprising the steps of carburizing while supplying a hydrocarbon gas and an oxidization gas into the furnace, stopping the supply of the oxidization gas when the partial pressure of CO in the furnace reaches a predetermined value, and controlling the supply quantity of the hydrocarbon gas so that the carbon potential in the furnace reaches a predetermined value.

In a preferred embodiment of the present invention, the hydrocarbon gas is butane, and the predetermined value for the partial pressure of CO is approximately 30%.

In another embodiment of the present invention, the hydrocarbon gas is propane, and the predetermined value for the partial pressure of CO is approximately 27%.

In another embodiment of the present invention, the hydrocarbon gas LPG, and the predetermined value for the partial pressure of CO is approximately 29%.

In another embodiment of the present invention, the hydrocarbon gas is methane, and the predetermined value for the partial pressure of CO is approximately 24%.

Still a further object of the present invention is to provide a method of controlling an atmosphere in a heat treatment furnace comprising the steps of carrying out a carburizing while supplying a hydrocarbon gas and an oxidization gas into the furnace, and controlling the supply quantity of the hydrocarbon gas so that the carbon potential in the furnace reaches a predetermined value.

In a preferred embodiment of the present invention, the supply of the hydrocarbon gas is stopped when the quantity of a residual $CH_4$ in the furnace is changed to increasing from decreasing.

Another object of the present invention is to provide an apparatus for controlling an atmosphere in a furnace comprising a furnace, a heater for heating the inside of the furnace, means for measuring a partial pressure of CO in the furnace, means for operating a carbon potential in the furnace, means for introducing a hydrocarbon gas and an oxidization gas into the furnace, and means for controlling the quantities of the hydrocarbon gas and the oxidization gas to be introduced into the furnace.

In a preferred embodiment of the present invention the hydrocarbon gas may comprise a liquid containing carbon atoms, or a gas such as acetylene, methane, propane, butane, or any other known gas containing a hydrocarbon as its main ingredient. Methane, propane, or butane gas is preferred.

In a preferred embodiment of the present invention, the oxidization gas is air or $CO_2$ gas.

The forgoing and other objects, features, and advantages of the present invention will become apparent from the following more particular description of preferred embodiments of the invention, as illustrated in the accompanying drawings.

BRIEF DESCRIPTION OF THE DRAWINGS

FIG. 11 is a table for explaining the quantity of an embodiment of consumed gas in each of the present invention and the endothermic method.

DESCRIPTION OF THE PREFERRED EMBODIMENT

Figure 1:
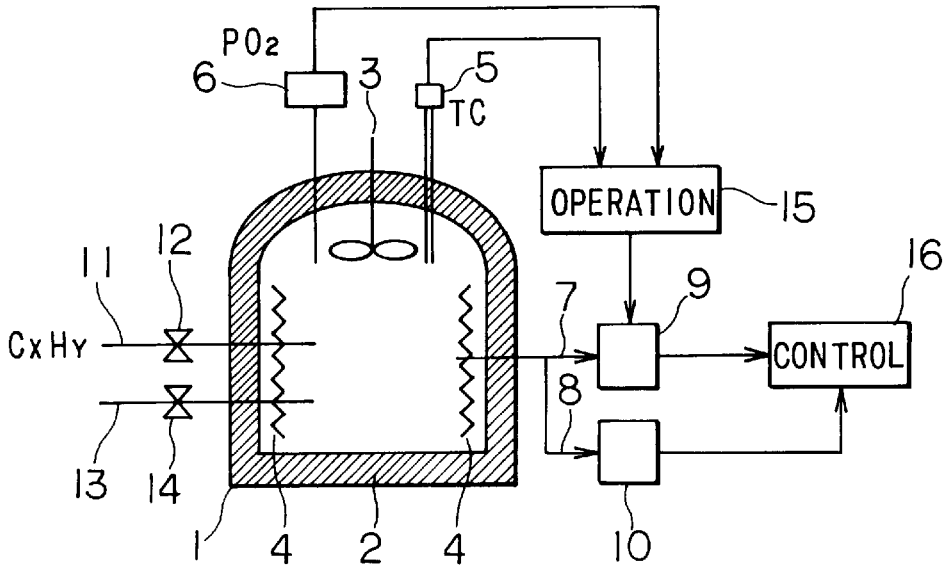
FIG. 1 is a view illustrating a method and apparatus for controlling an atmosphere in a heat treatment furnace in accordance with a preferred embodiment of the present invention.

FIG. 1 shows a control apparatus for a heat treatment furnace according to the present invention.

In FIG. 1, reference numeral 1 denotes a shell of furnace, 2 denotes a refractory brick forming the shell of furnace 1, 3 denotes a fan for recirculating the atmosphere in the furnace, 4 denotes a heater, 5 denotes a thermocouple for controlling the temperature in the furnace, 6 denotes a zirconian type sensor for sensing the partial pressure of a solid electrolyte oxygen, for example, which is inserted directly into the furnace, 8 denotes a tube for measuring the partial pressure of $CH_4$, 9 denotes an analyzer for analyzing the partial pressure of CO, 10 denotes an analyzer for analyzing the partial pressure of $CH_4$, 11 denotes a pipe for introducing hydrocarbon gas into the furnace, 12 denotes a control valve inserted into the pipe 11, 13 denotes a pipe for introducing oxidization gas into the furnace, 14 denotes a control valve inserted into the pipe 13, 15 denotes an operating apparatus of the carbon potential, and 16 denotes a controller for supplying control signals to the valves 12 and 14.

Figure 2:
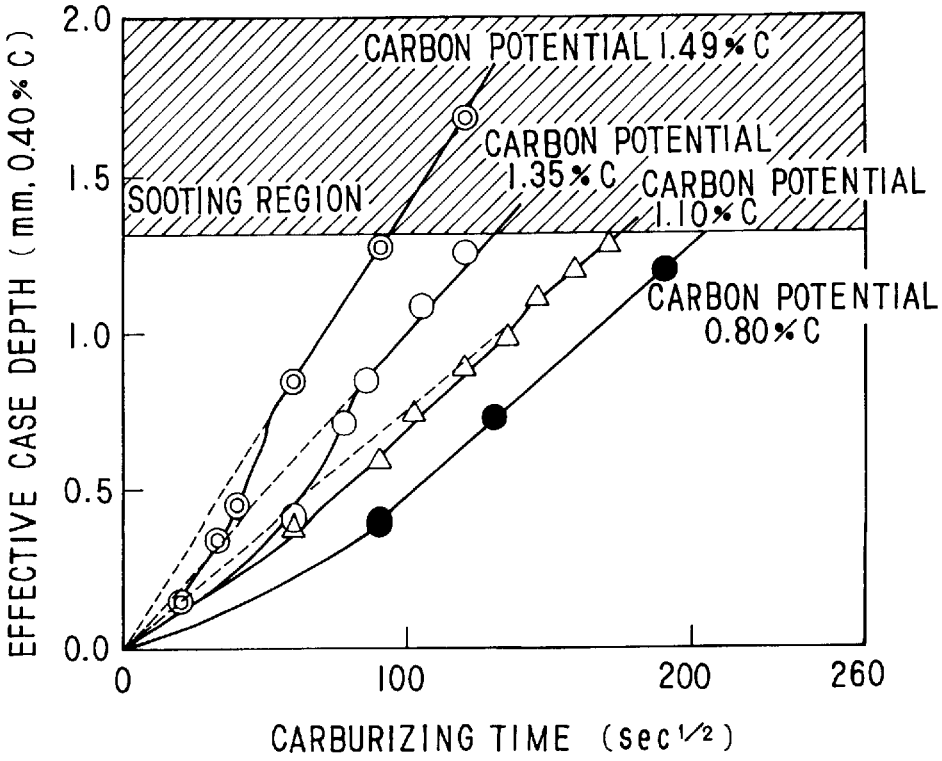
FIG. 2 is a graph explaining the relationship between the effective case depth and the carburizing time according to the carbon potential.

FIG. 2, shows the relationship between the effective case depth and the carburizing time according to the carbon potential.

As shown in FIG. 2, it is publicly known that if the carbon potential in the carburizing time is higher, the carburizing can be completed with a shorter time period and that it is not suitable to carry out the heat treatment in the hatched sooting region of the Fe-C series equilibrium diagram shown in FIG. 2.

Figure 3:
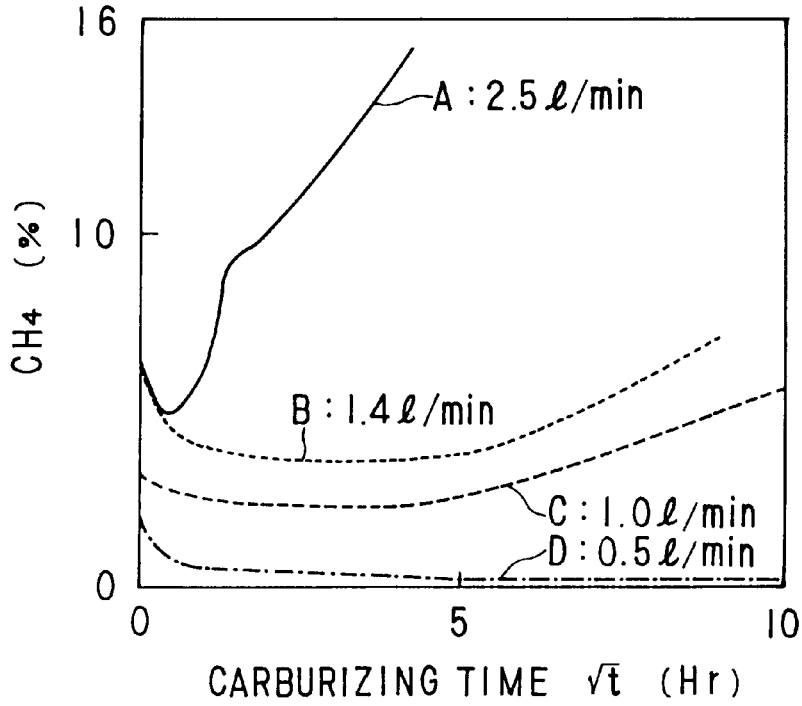
FIG. 3 is a graph explaining the relationship between the quantity of residual $CH_4$ and the carburizing time according to the quantity of added enriched gas.

It is better to add a large quantity of enriched gas (hydrocarbon gas) in order to increase the carbon potential. Referring to FIG. 3, if the goods to be treated are 150 kg, and if $C_4H_{10}$ gas of 2.5 liter/minute is introduced (case A), $C_4H_{10}$ gas of 1.4 liter/minute is introduced (case B), and $C_4H_{10}$ gas of 1.0 liter/minute is introduced (case C), the quantity of residual $CH_4$ is decreased and then increased with time, so that the goods are sooted. However, when $C_4H_{10}$ gas of 0.5 liter/minute is introduced (case D), the quantity of residual $CH_4$ is constant substantially, so that the goods are not sooted. It is considered that in the cases of (A), (B) and (C), the quantity of added $C_4H_{10}$ gas is large and accordingly some carbon cannot be absorbed by the steel, so that the quantity of undecomposed residual $CH_4$ is increased, but in case of (D), entire carbon can be absorbed by the steel. Accordingly, the sooting can be prevented by analyzing the quantity of residual $CH_4$ and controlling it.

As apparent from the Fe-C series equilibrium diagram, the sooting can be prevented by measuring the partial pressure of oxygen corresponding to the maximum carbon solid solution, because the maximum carbon solid solution is constant at a specific temperature.

Figure 4:
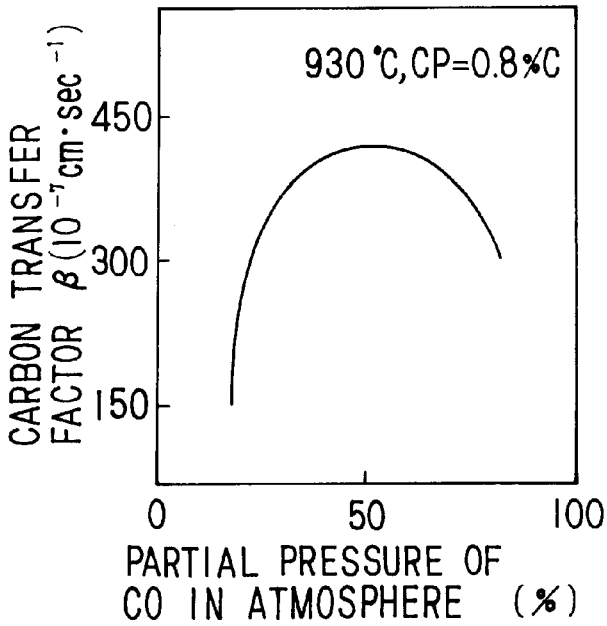
FIG. 4 is a graph explaining the relationship between the partial pressure of CO in the furnace and the carbon transfer coefficient.
Figure 5:
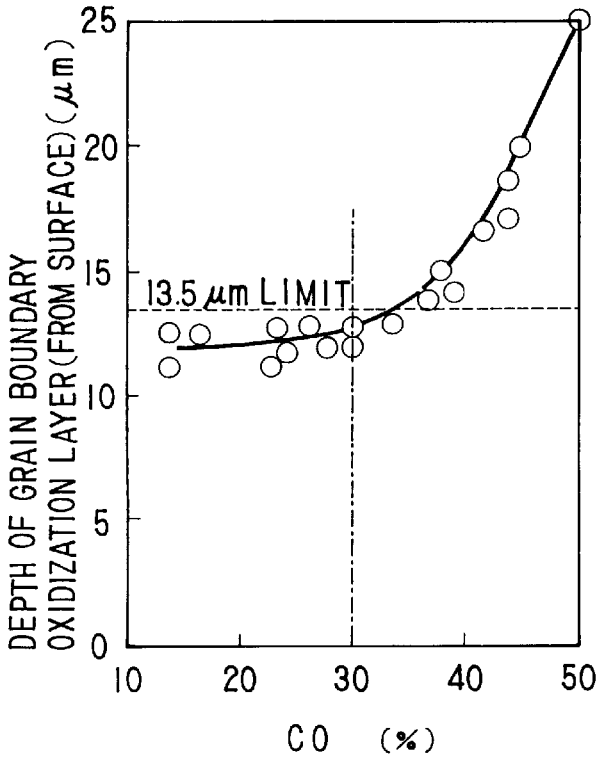
FIG. 5 is a graph explaining the relationship between CO% and the depth of the grain boundary oxidization layer.

As shown in FIG. 4, the carburizing speed is varied according to the carbon transfer factor $\beta$ and is maximized when the partial pressure of CO in the carburizing furnace atmosphere is 50%. Further, if the partial pressure of CO is increased, the partial pressure of $CO_2$ is also increased. FIG. 5 shows the relationship between the depth of the grain boundary oxidization layer from the surface and the partial pressure of CO (the partial pressure of CO is in proportion to the partial pressure of $CO_2$).

It is publicly known that the depth of grain boundary oxidization layer is limited to 13.5 $\mu$m in consideration of the affection on the figure strength of materials. Accordingly, an optimum partial pressure of CO is determined by the value of the partial pressure of CO corresponding to the depth of 13.5 $\mu$m. The optimum value is approximately 30% CO when the hydrocarbon series gas is butane. Accordingly, in the present invention, when the partial pressure of CO in the furnace reaches approximately 30%, the optimum partial pressure of CO is judged from the analyzing result of the analyzer 9 and the control valve 14 for the oxidization gas is closed.

Figure 6:
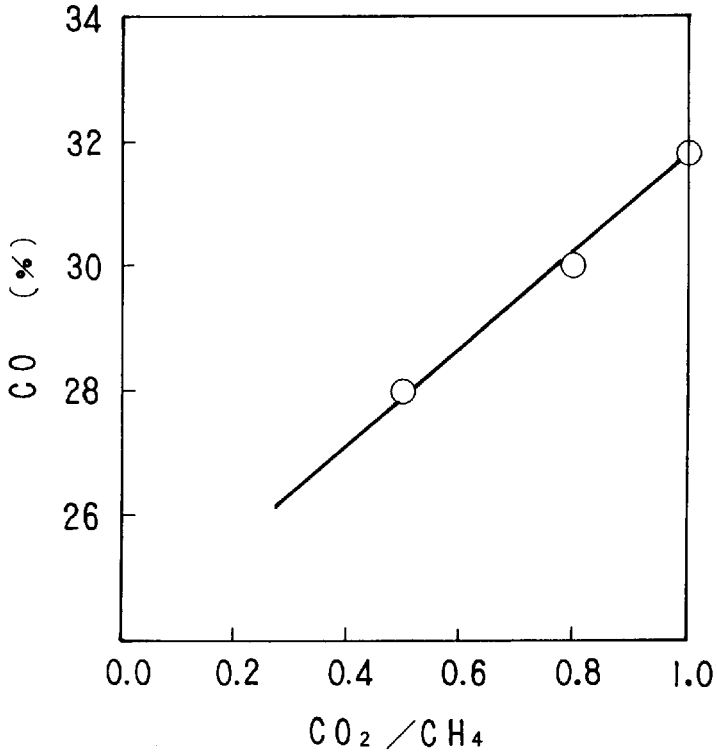
FIG. 6 is a graph explaining the relationship between $CO_2/CH_4$ and CO%.

As apparent from the experimental result shown in FIG. 6, $CH_4$ and $CO_2$ react in a 1:1 ratio stoichiometrically, so that the control valve 14 is adjusted so that the hydrocarbon gas is varied centering around approximately 30% CO, when the hydrocarbon gas is butane. However, in actuality, the ratio of $CO_2$ and $CH_4$ becomes other than 1:1, because air enters the furnace when the goods to be treated are introduced into the furnace and the hermetical seal of the furnace is disordered. Accordingly, each of valves 12 and 14 is controlled according to the result of measurement of the partial pressure of CO.

The same effect can be obtained by controlling the quantity of the hydrocarbon gas to be introduced into the furnace while maintaining the quantity of the oxidization gas constant.

As stated above, when CO is controlled to approximately 30%, the following formula can be obtained:

$$a_c = Pco/(Kp \cdot Po_2^{1/2}) \quad (1)$$

where $a_c$ is the activity of carbon in austenite, Kp is the equilibrium constant obtained from $<C> + \frac{1}{2} \cdot O_2 \rightarrow CO$, and $PO_2$ is the partial pressure of oxygen.

Accordingly, $a_c$ can be expressed as a function of $PO_2^{1/2}$, because Kp is constant if the temperature and CO are constant. In order to obtain a required carbon potential, the valve 12 for the hydrocarbon gas is opened if the value of the electromotive force of oxygen is less than a required value, and the valve 12 is closed if the value of the electromotive force of oxygen is greater than the required value.

The carbon potential can be obtained if CO and $O_2$ are operated by substituting the analyzing result of CO into the formula (1).

When the temperature is varied, the change of Kp is calculated automatically (for example, by the formula, log Kp=5840.6/T+4.583) and the operation is carried out by substituting the value of the change of Kp into the formula (1).

(Embodiment 1)

A batch furnace is used, the goods to be treated approximately 150 kg are introduced into the furnace, and the carburizing operation is carried out for approximately four hours at 930° C. by using $C_4H_{10}$ gas as a hydrocarbon gas and $CO_2$ gas as an oxidization gas.

Figure 7:
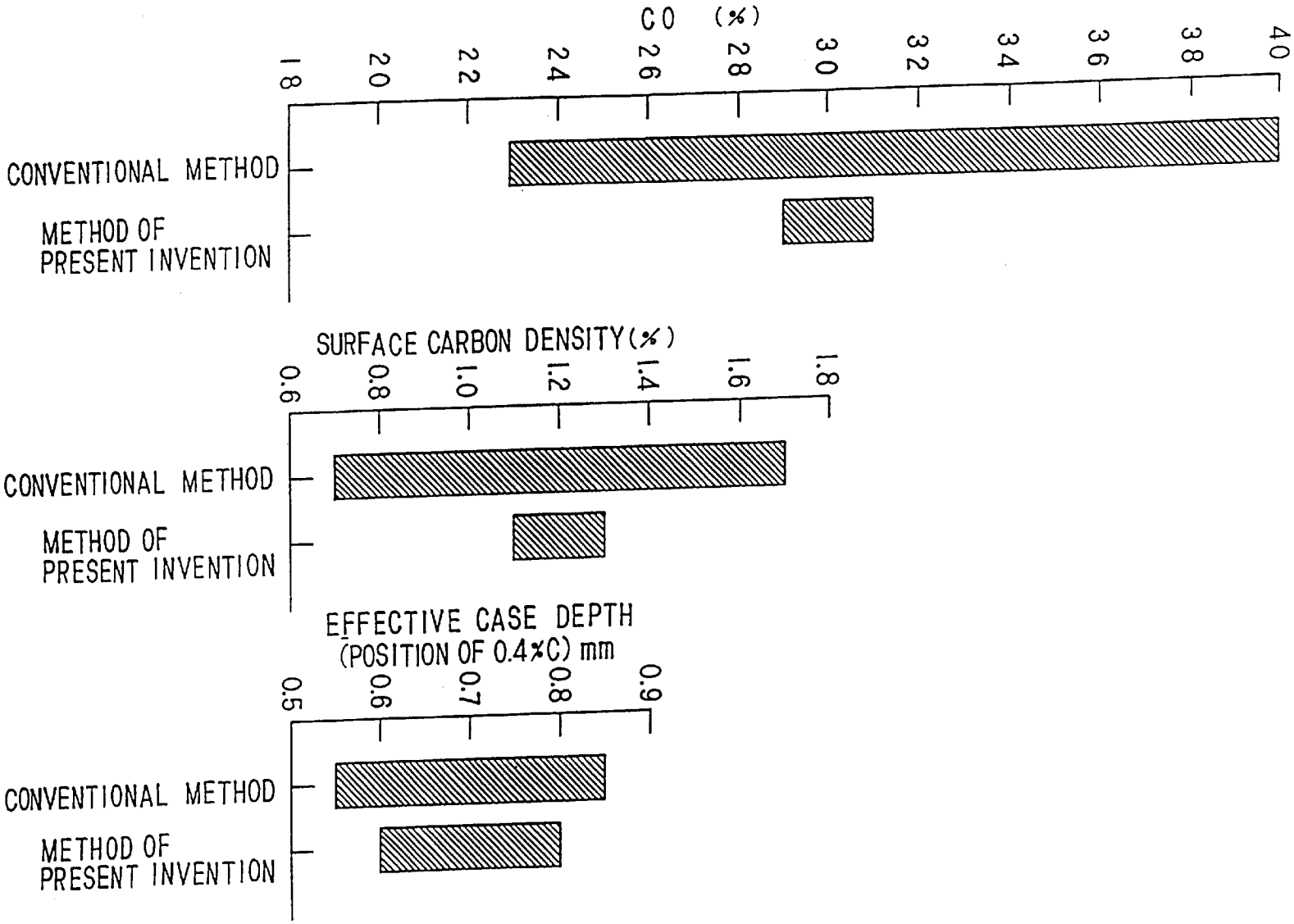
FIG. 7 is a graph explaining the relationship between a preferred embodiment of the present invention and the conventional method with respect to the changes in CO%, the surface carbon contents, and the effective case depth.

FIG. 7 shown the differences between a preferred embodiment of the present invention and the methods shown in the Japanese Patent Applications Laid-Open Nos. 159567/1986 and 63260/1992 with respect to the partial pressure of CO, the surface carbon contents of goods to be treated and the effective case depth when the heat treatment is carried out.

As shown in FIG. 7, according to an embodiment of the present invention the fluctuation of CO with respect to CO % can be reduced in the range of 28.5–31.5% (30%±1.5%) when the hydrocarbon gas is butane and the desired value of CO % is 30%, whereas according to the conventional methods the fluctuation of CO is in the range of 23–40%.

Furthermore, according to an embodiment of the fluctuation of surface carbon contents can be reduced in the range of 1.10–1.30% when the desired value is 1.20%, whereas according to the conventional methods the fluctuation of surface carbon contents is in the range of 0.7–1.70%.

Similarly, according to an embodiment of the present invention the fluctuation of effective case depth can be reduced in the range of 0.6–0.8 mm when the desired value of effective case depth is 0.7 mm, whereas according to the conventional methods the fluctuation of effective case depth is in the range of 0.55–0.85 mm.

Figure 8:
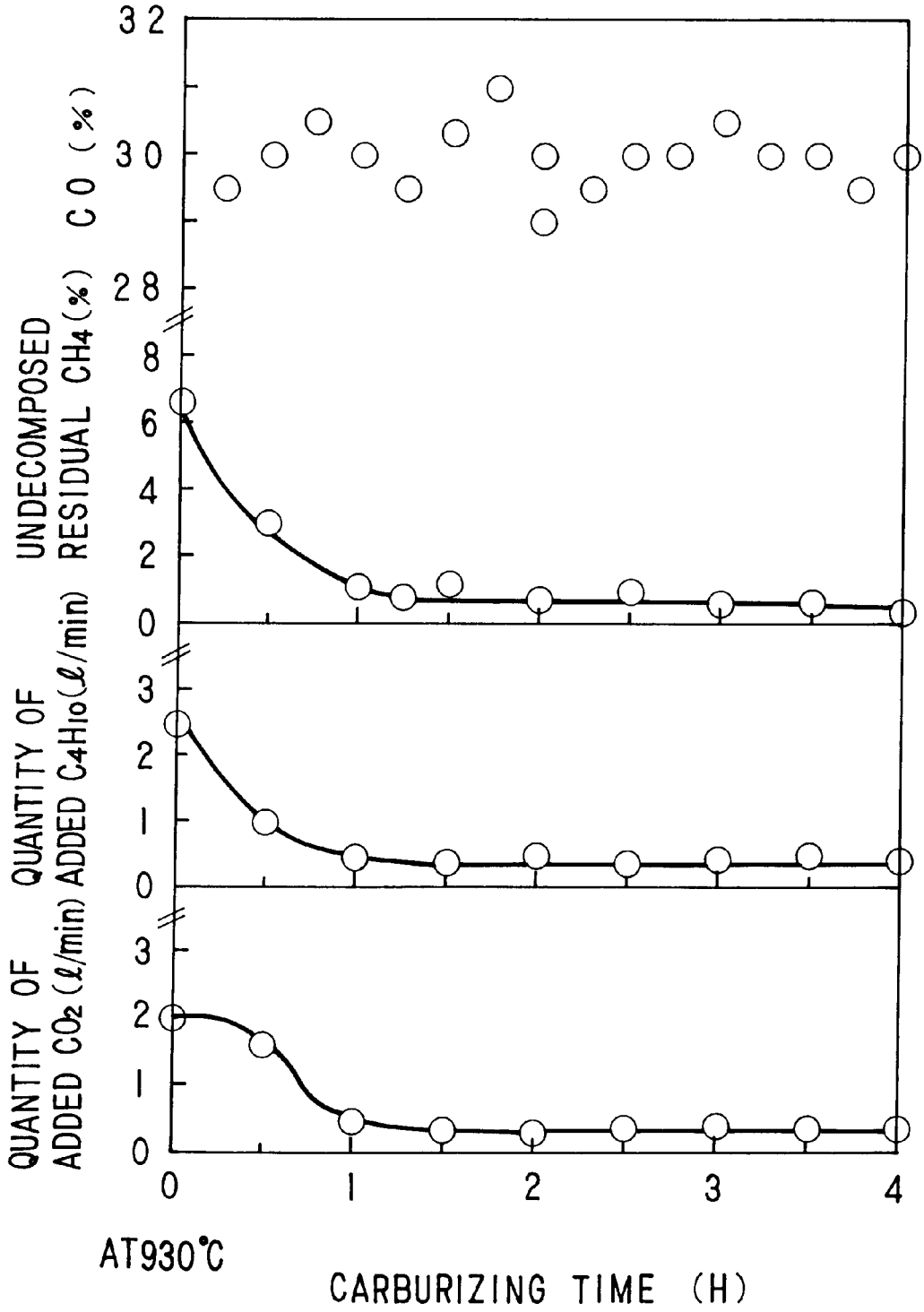
FIG. 8 is a graph explaining the relationship between the changes in the quantity of undecomposed residual $CH_4$, the quantity of added $C_4H_{10}$, and the quantity of added $CO_2$, according to the carburizing time.

FIG. 8 shows the relationship between the change in quantity of added gases with time and the change of the partial pressure of CO with time, where the maximum quantity of $C_4H_{10}$ gas passing through the value 12 is set to 2.5 liter/minute, and the maximum quantity of $CO_2$ gas passing through the valve 14 is set to 2.0 liter/minute. Each quantity of added $C_4H_{10}$ and $CO_2$ is maximized at approximately 930° C., however, each of the valves 12 and 14 is controlled directly according to the analyzing result of CO, so that the quantity of CO is controlled with the precision of 30%±1.05%.

As shown in FIG. 3, the quantity of $CH_4$ increases with time when more than 1.0 liter/minute of butane is added as the hydrocarbon gas. This means that the residual $CH_4$ is undecomposed and accumulated in the furnace, so that the sooting is accelerated.

As apparent from FIG. 8 when butane of 2.5 liter/minute is added as the hydrocarbon gas at 930° C., the sooting is occurred. However, the sooting can be prevented, because the quantity of the hydrocarbon gas to be introduced is reduced gradually in the present invention.

Furthermore, as shown in FIG. 8, the fluctuation of CO in the atmosphere could be controlled to 30%±1.50%, when butane is added as the hydrocarbon gas while the weight of goods introduced into the furnace is varied from 150 kg÷2 to 150 kg×2, or the weight is set to a predetermined value and the surface area is reduced by one half or increased by six times.

(Embodiment 2)

Figure 9:
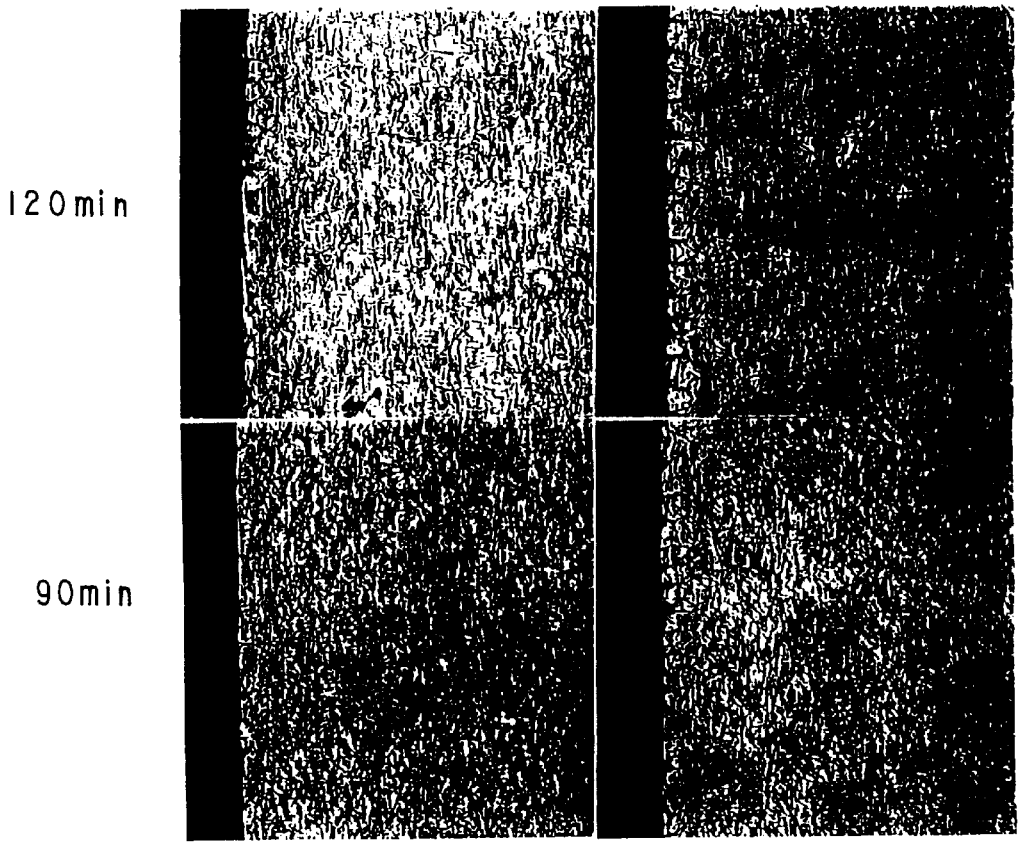
FIG. 9 shows microphotographs of structure showing the grain boundary layer oxidization of the present invention and the conventional method.

FIG. 9 shows the microphotographs of structure of carburizing when butane is used as the hydrocarbon gas according to a preferred embodiment of the present invention (CO is approximately 30%) and according to the conventional method using an endothermic gas (CO is approximately 23%). The microphotograph of right side shows that of the present invention, whereas an embodiment of the left side shows that of the conventional method.

In each of the microphotographs, the left side is the surface where the grain boundary oxidization has occurred. The depth of grain boundary oxidization layer is about 10 μm in both cases. This means that the grain boundary oxidization is not accelerated, because CO is controlled to approximately 30%.

(Embodiment 3)

Figure 10:
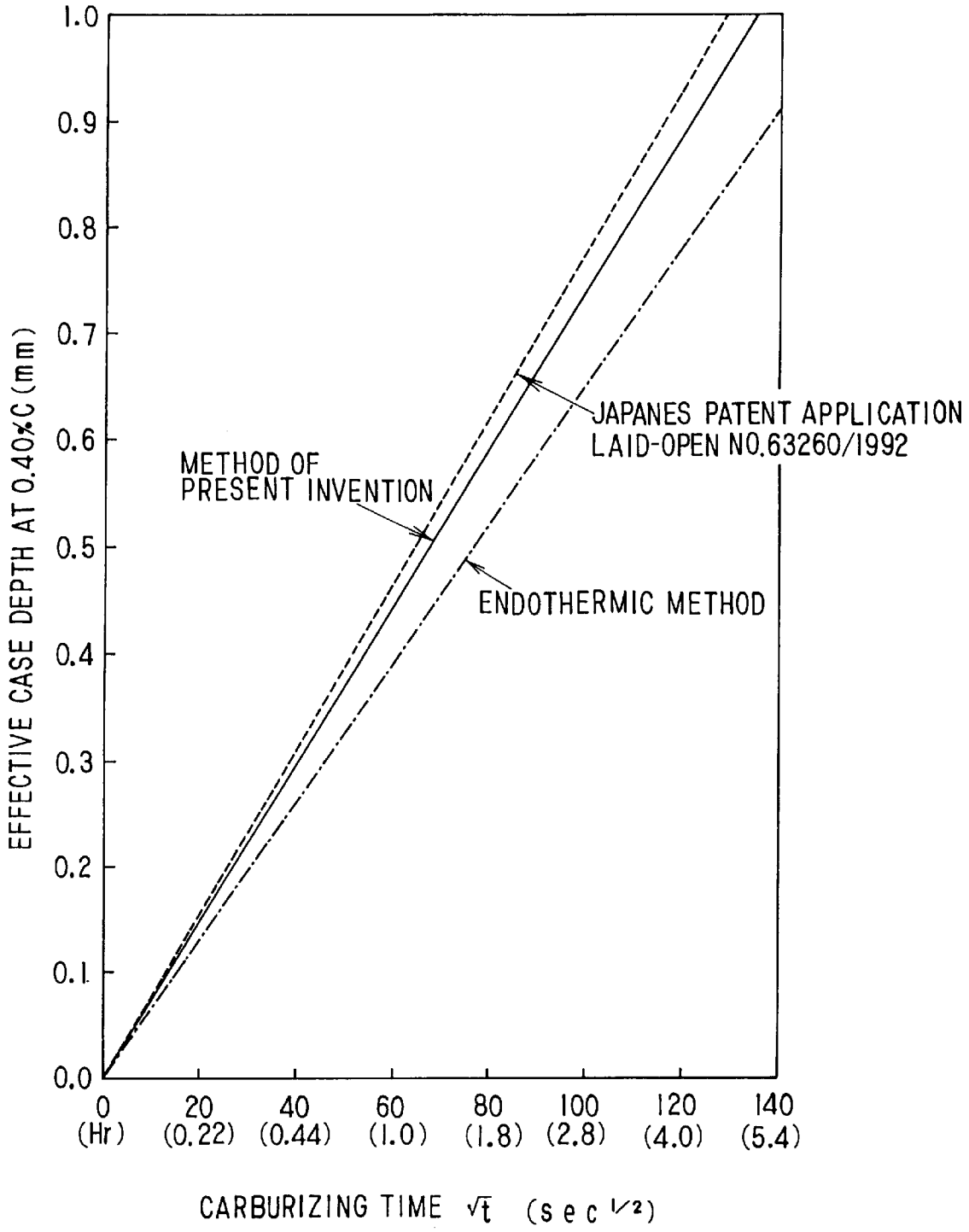
FIG. 10 is a graph explaining the relationship between the carburizing time and the effective case depth in each of an embodiment of the present invention and the conventional method.

FIG. 10 shows the relationship between the carburizing time and effective case depth when the goods of approximately 150 kg are carburized at approximately 930° C. according to the method of the preferred embodiment of the present invention and the conventional method. It is apparent from FIG. 10 that according to the preferred embodiment, effective case depth becomes larger by approximately 19% during a predetermined carburizing time than when the endothermic gas is used. Accordingly, in the preferred embodiment, the carburizing time can be shortened when effective case depth is set to a predetermined value, compared to the conventional method.

(Embodiment 4)

FIG. 11 shows the comparison of consumed gas in the preferred embodiment of the present invention wherein $C_4H_{10}$ gas and $CO_2$ gas are used and in the conventional method wherein endothermic gas as the raw gas and $C_4H_{10}$ gas as the enriched gas are used, when the carburizing is carried out to obtain a depth of effective hardened layer of 1 mm (corresponding to 0.4% C) while the heat treating temperature is 930° C., and the carbon potential is fixed at 1.0%. As a result, according to the preferred embodiment, the quantity of $C_4H_{10}$ gas to be used for obtaining the depth of effective hardened layer of 1 mm can be reduced by 69% compared to that in the conventional endothermic gas method.

As the hydrocarbon gas, gas such as acetylene, methane, propane or butane gas containing a hydrocarbon for its main ingredient is used. Methane, propane, or butane gas is preferred.

Air or $CO_2$ gas is used as the oxidization gas.

Furthermore, according to the preferred embodiment, the sooting can be prevented by closing the control valve 12 in accordance with the analyzing result of the analyzer 10 when the quantity of the residual $CH_4$ is changed to increasing from decreasing to stop the introduction of hydrocarbon gas $C_XH_Y$ and to prevent the residual $CH_4$ from increasing.

Furthermore, in the preferred embodiment, the partial pressure of oxygen is measured by measuring the electromotive force of the sensor 6, and the control valve 12 is closed when the partial pressure of oxygen reaches a predetermined value, so that the sooting can be prevented.

As stated above, according to the preferred embodiment, even if the type (weight and surface area) of goods to be treated or the empty furnace holding time is changed the carbon potential can be maintained constant and the quality of goods to be treated can be stabilized, by controlling the quantities of hydrocarbon gas and oxidization gas to be added to maintain the partial pressure of CO in the atmosphere constant, in the heat treatment, such as gas carburizing, carbonitriding or the bright controlled atmosphere heat treatment.

Furthermore, according to the present invention, the sooting can be prevented in advance by controlling the quantity of hydrocarbon gas to be added according to the partial pressure of $CH_4$ and partial pressure of oxygen in the atmosphere of the heat treatment.

While the invention has been particularly shown and described with reference to the preferred embodiments thereof, it will be understood by those skilled in the art that various changes in form and details may be made therein without departing from the spirit and scope of the invention as defined by the appended claims.

What is claimed is:

1. A method of controlling an atmosphere in a heat treatment furnace comprising:

carburizing while supplying a hydrocarbon gas and an oxidization gas into the furnace; and stopping the supply of the oxidization gas when a partial pressure of CO in the furnace reaches a value corresponding to a depth of a grain boundary oxidization layer on a workpiece of approximately 13.5 $\mu$m.

2. A method of controlling an atmosphere in a heat treatment furnace comprising:

carburizing while supplying a hydrocarbon gas and an oxidization gas into the furnace;

stopping the supply of the oxidization gas when a partial pressure of CO in the furnace reaches a value corresponding to a depth of a grain boundary oxidization layer on a workpeice of approximately 13.5 $\mu$m; and controlling the supply quantity of the hydrocarbon gas so that a carbon potential in the furnace reaches a value as defined by the equation $$a_c = Pco/(Kp \cdot Po_2^{1/2}),$$

wherein;

$a_c$ is the carbon potential,

Pco is the partial pressure of CO, $Po_2$ is a partial pressure of O2, and

Kp is an equilibrium constant.

3. The method of controlling an atmosphere in a heat treatment furnace as claimed in claim 1, wherein the hydrocarbon gas is butane, and the partial pressure of CO is approximately 30%.

4. The method of controlling an atmosphere in a heat treatment furnace as claimed in claim 1, wherein the hydrocarbon gas is propane, and the partial pressure of CO is approximately 27%.

5. The method of controlling an atmosphere in a heat treatment furnace as claimed in claim 1, wherein the hydrocarbon gas is LPG, and the partial pressure of CO is approximately 29%.

6. The method of controlling an atmosphere in a heat treatment furnace as claimed in claim 1, wherein the hydrocarbon gas is methane, and the partial pressure of CO is approximately 24%.

7. A method of controlling an atmosphere in a heat treatment furnace comprising:

carburizing while supplying a hydrocarbon gas and an oxidization gas into the furnace; and controlling the supply quantity of the hydrocarbon gas so that a carbon potential in the furnace reaches a value as defined by the equation $$a_c = Pco/(Kp \cdot Po_2^{1/2}),$$

wherein;

$a_c$ is the carbon potential,

Pco is a partial pressure of CO, $Po_2$ is a partial pressure of O2, and

Kp is an equilibrium constant.

8. The method of controlling an atmosphere in a heat treating furnace as claimed in claim 1, wherein the supply of the hydrocarbon gas is stopped when the quantity of a residual CH4 in the furnace is changed to increasing from decreasing.

9. The method of controlling an atmosphere in a heat treating furnace as claimed in claim 1, wherein the hydrocarbon gas contains hydrocarbon as its main ingredient, and comprises one of acetylene, methane, propane and butane.

10. The method of controlling an atmosphere in a heat treating furnace as claimed in claim 1, wherein the oxidization gas comprises one of air and CO2 gas.

11. In combination:

(A) a furnace; and (B) a control apparatus for controlling an atmosphere in the furnace, the control apparatus including a heater for heating an inside of the furnace, means for measuring a partial pressure of CO in the furnace, means for operating a carbon potential in the furnace, means for introducing a hydrocarbon gas and an oxidization gas into the furnace, means for controlling the quantities of the hydrocarbon gas and the oxidization gas to be introduced into the furnace, and means for controlling the supply quantity of the hydrocarbon gas so that the carbon potential in the furnace reaches a value as defined by the equation $$a_c = \mathrm{Pco}/(Kp \cdot Po_2^{1/2}),$$

wherein;

$a_c$ is the carbon potential,

Pco is the partial pressure of CO, $Po_2$ is a partial pressure of O2, and

Kp is an equilibrium constant.

12. The control apparatus for controlling an atmosphere in a furnace as claimed in claim 11, further comprising means for measuring a partial pressure of oxygen and a partial pressure of $CH_4$ in the furnace.

13. The control apparatus for controlling an atmosphere in a furnace as claimed in claim 11, wherein the hydrocarbon gas contains hydrocarbon as its main ingredient, and comprises one of a group of acetylene, methane, propane and butane.

14. The control apparatus for controlling an atmosphere in a furnace as claimed in claim 11, wherein the oxidization gas comprises one of air and CO2 gas.

15. In combination:

(A) a furnace; and (B) a control apparatus for controlling an atmosphere in the furnace, the control apparatus including a heater for heating an inside of the furnace, means for measuring a partial pressure of CO in the furnace, means for operating a carbon potential in the furnace, means for introducing a hydrocarbon gas and an oxidization gas into the furnace, means for controlling quantities of the hydrocarbon gas and the oxidization gas to be introduced into the furnace, and means for stopping the supply of the oxidization gas when the partial pressure of CO in the furnace reaches a value corresponding to a depth of grain boundary oxidization layer on a workpiece of approximately 13.5 $\mu$m.

* * * * *